US008388339B2

(12) United States Patent
Beilfuss

(10) Patent No.: US 8,388,339 B2
(45) Date of Patent: Mar. 5, 2013

(54) SINGLE MICRO-PIN FLAME SENSE CIRCUIT AND METHOD

(75) Inventor: Robert C. Beilfuss, West Chicago, IL (US)

(73) Assignee: Robertshaw Controls Company, Carol Stream, IL (US)

( * ) Notice: Subject to any disclaimer, the term of this patent is extended or adjusted under 35 U.S.C. 154(b) by 1111 days.

(21) Appl. No.: 12/338,095

(22) Filed: Dec. 18, 2008

(65) Prior Publication Data

US 2010/0159408 A1 Jun. 24, 2010

(51) Int. Cl.
*F23N 5/00* (2006.01)

(52) U.S. Cl. ..... 431/66; 431/12; 431/25; 431/19; 431/20; 431/31; 126/116 A

(58) Field of Classification Search ..... 431/66, 431/25, 12, 19, 20, 31; 126/116 A
See application file for complete search history.

(56) References Cited

U.S. PATENT DOCUMENTS

| | | | | |
|---|---|---|---|---|
| 3,574,496 | A | 4/1971 | Hewitt | |
| 3,877,864 | A | 4/1975 | Carlson | |
| 4,626,196 | A | 12/1986 | Stohrer, Jr. | |
| 4,632,032 | A * | 12/1986 | Muller | 102/206 |
| 5,026,270 | A * | 6/1991 | Adams et al. | 431/24 |
| 5,169,303 | A | 12/1992 | Paluck | |
| 5,246,365 | A | 9/1993 | Himmel et al. | |
| 5,722,822 | A * | 3/1998 | Wilson et al. | 431/25 |
| 6,222,719 | B1 | 4/2001 | Kadah | |
| 6,567,695 | B1 * | 5/2003 | Gruzdowich et al. | 607/2 |
| 6,985,080 | B2 | 1/2006 | Kociecki et al. | |
| 7,148,454 | B2 | 12/2006 | Chodacki et al. | |
| 2002/0167336 | A1 * | 11/2002 | Jamieson et al. | 326/99 |

FOREIGN PATENT DOCUMENTS

WO WO 2004/083728 A1 9/2004

* cited by examiner

*Primary Examiner* — Avinash Savani
(74) *Attorney, Agent, or Firm* — Reinhart Boerner Van Deuren P.C.

(57) ABSTRACT

A flame sense circuit and method utilizing only a single pin of a microcontroller is provided. A flame sense circuit is used to vary the charge on a capacitor from a logic high indicating no flame to a logic low when a flame is detected. The microcontroller changes the state of the pin coupled to this circuitry from a high impedance input to detect when the capacitor is discharged indicating the presence of flame, to a logic high output to recharge the flame sense capacitor. Once this charging has been accomplished, the microcontroller again changes the status of the pin to a high impedance input and verifies that the capacitor has been charged. This pin is monitored to verify that the flame sense capacitor is again discharged to indicate the continued presence of flame. This process is repeated to ensure flame continues to be present during a combustion event.

15 Claims, 2 Drawing Sheets

SINGLE MICRO-PIN FLAME SENSE CIRCUIT AND METHOD

FIELD OF THE INVENTION

The present invention relates generally to flame sense circuitry, and more particularly to flame sense circuitry for use in consumer and commercial appliances utilizing electronic, microprocessor- and/or microcontroller-based controls.

BACKGROUND OF THE INVENTION

Gas burning consumer and commercial appliances, for example hot water heaters, furnaces, stoves, etc. include various control and safety mechanisms to ensure safe operation thereof. One such safety control circuit used to ensure that the uncombusted release of gaseous fuel does not occur, or if occurring is minimized, is a flame sense circuit. Such circuitry utilizes the rectification property of a flame to detect its presence or absence to control the flow of fuel to the burner of the appliance.

Such flame sensing is used to ensure that the release of gaseous fuel is being combusted at the burner during periods that heating is required. Depending on the control mechanism and programming, the flame sense input may be used simply to determine whether proper combustion is occurring, or may be utilized as a control input to re-trigger the flame ignition circuitry to attempt to relight the flame. In some systems, the absence of flame when heating is commanded will result in a shutdown of the system and possible lockout.

The flame sense circuitry is also utilized to detect the presence of flame when no combustion event is commanded to identify possible failures in the gas control valves. If such a flame is detected when no combustion is commanded, the appliance will typically enter a purge or lockout mode of operation and will signal a failure so that service personnel may be alerted to the potential failure within the system.

Typical flame sense circuits for use in appliances that utilize electronic microprocessor- or microcontroller-based control utilize two separate pins on the microcontroller for each flame sense circuit in a flame rectification detection system. The first pin of the microcontroller is used as an input that reads the charge state of a capacitor that changes whenever a flame is present. The second pin of the microcontroller is used as an output to allow the flame capacitor to recharge to the "no flame" state whenever a flame has been successfully detected.

The controller allows gas to flow to the burner so long as the system can continually verify the presence of flame using these two microcontroller pins. In other words, the microcontroller reads the input pin to determine if flame is present, resets the flame sense circuit with the output pin, reads the input pin to make sure flame is still present, etc. so long as the combustion event is commanded. If at any point during the combustion event, flame is not detected on the input pin after it has been reset by the output pin, the controller knows that a problem has occurred resulting in the flame being extinguished.

In a complete cycle, therefore, the electronic gas controller initially monitors the input pin to verify that no flame is present when the gas has not been commanded to flow. Assuming that this step is successfully passed, the controller energizes the electronic gas control valve and the ignition circuitry to allow the gaseous fuel to flow to the burner and be ignited by the ignition circuitry. This ignition circuitry may be a direct spark ignition (DSI), hot surface ignition (HSI), or other ignition method known in the art. Assuming successful ignition of the gaseous fuel, the flame sense circuit will detect the presence of flame, and the electronic controller will read the input to verify that a flame has been detected. The controller continues to allow gas to flow since it has verified that a flame is present. To ensure that a flame continues to burn during the entire combustion event, the microcontroller resets the flame sense circuit to the no flame state, and then waits a predetermined period of time to verify that the flame sense circuit has again detected the presence of flame. This process continues during the combustion event so long as the microcontroller continues to verify that flame is present each time after the flame sense circuit has been reset.

If, however, the flame sense circuit does not detect the presence of flame after it has been reset, the microcontroller either reinitiates the ignition circuitry to attempt to reignite the gaseous fuel, or commands the electronic gas control valve to turn off to stop the flow of gaseous fuel to the burner, depending on the programming of the system. In any event, if the gaseous fuel is unable to be ignited as determined by a failure of the flame sense circuit to detect the presence of flame, the system will enter a lockout and will typically provide an alert that a failure has occurred so that the appliance may be serviced.

While such flame sense circuits and methodologies work well, the increasing complexity of such appliances driven by the increase in number of features and cycles, as well as the highly cost competitive nature of consumer and commercial appliance industry, have caused designers to critically analyze every aspect of the appliance design to identify potential areas for simplification and cost reduction. Unfortunately, because the detection of flame is such a critical safety feature in consumer and commercial gas burning appliances, continuously being able to reset and re-verify the presence of flame has precluded changes in such circuitry. With some gas burning appliances having multiple burners, e.g. some ranges have two ovens, possibly each with a broiler, and multiple surface burners, the number of pins dedicated to flame sense becomes excessive. Further, increasing demands on utilization of microcontroller real estate, i.e. the utilization of pins on the microcontroller, has caused many manufactures to move to much more expensive, larger microcontrollers in order to add additional features while maintaining the required safety margin in such gas burning appliances.

In view of the above, there is a need in the art for a system and method of reliably detecting the presence of flame and continually being able to verify its continued presence during a combustion mode of operation while reducing the design footprint and complexity, while maintaining the required reliability, of such circuits. The system and method of the present invention provide such a flame sense circuit and method.

BRIEF SUMMARY OF THE INVENTION

In view of the above, embodiments of the present invention provide a new and improved flame sense circuit for use in consumer and commercial gas burning appliances. More particularly, embodiments of the present invention provide a new and improved flame sense circuit for use in consumer and commercial appliances that reduces the design footprint and utilization of pins of the microcontroller while providing continual safe and reliable detection of flame.

In one embodiment of the present invention, a flame sense circuit utilizing the rectification property of flame is used. In this embodiment, only a single pin on the microcontroller is utilized to both sense and reset this flame sense circuitry to continually verify the presence of flame during a combustion event. During a flame detection mode of operation, the pin of the microcontroller is set to a high impedance input in order to detect the flame. Flame is detected when a logic low is seen on this pin. Once the flame has been detected, the microcontroller changes that pin from a high impedance input pin to a logic high output in order to recharge the flame sense capacitor to a logic high. The microcontroller then again changes the pin characteristic to a high impendence input to verify that the capacitor is charged to a logic high. The pin is monitored to verify that, in the presence of flame, the flame capacitor is again discharged to a logic low. This cycling of the microcontroller's flame sense pin continues during the combustion event to ensure failsafe operation of the gas burning appliance while utilizing half of the number of pins of the controller.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
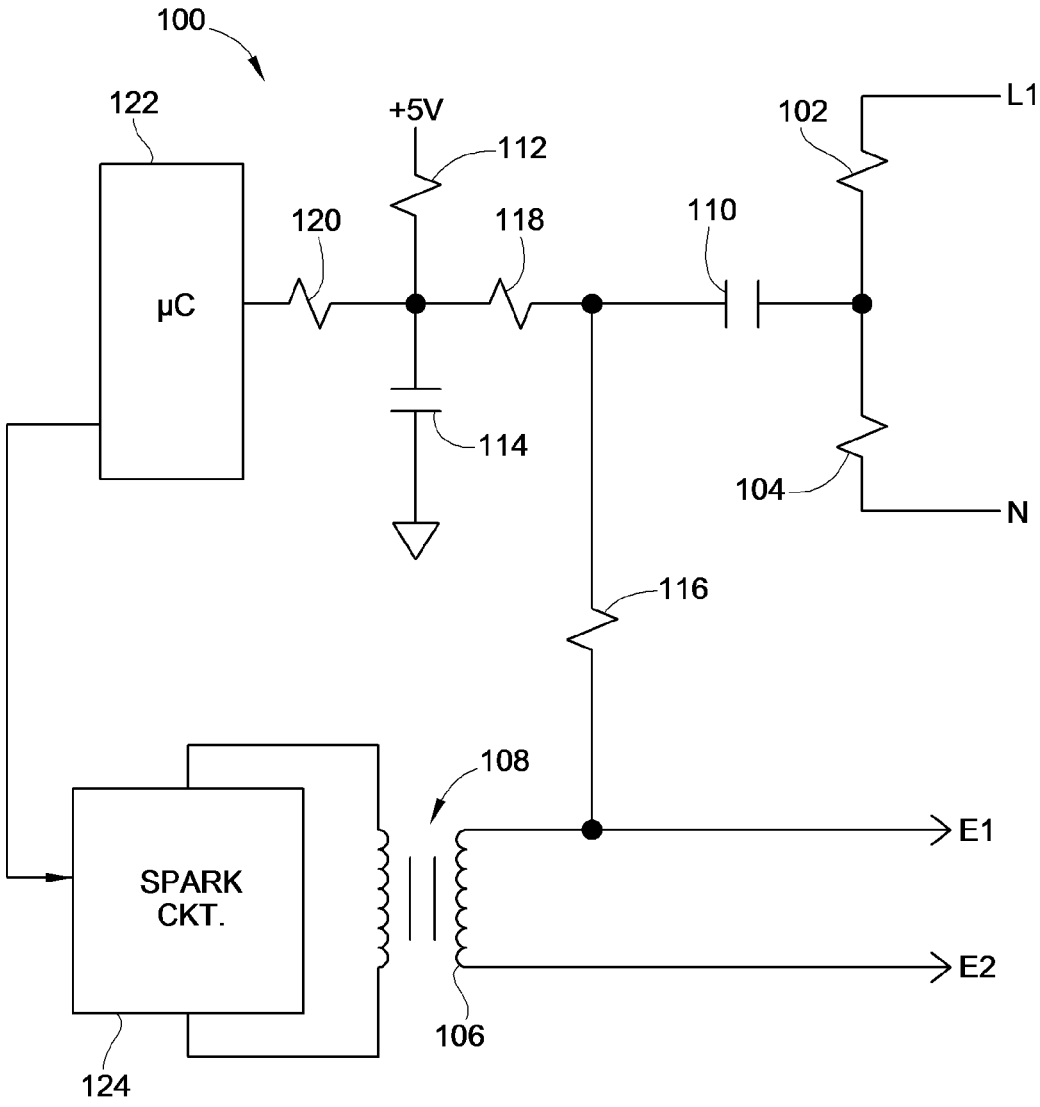
FIG. 1 is a simplified single line schematic diagram of one embodiment of a flame sense circuit constructed in accordance with the teachings of the present invention.

Turning now to the drawings, there is illustrated in FIG. 1 a simplified single line schematic of an embodiment of a flame sense circuit constructed in accordance with the teachings of the present invention. Such a circuit may be used, for example, in a gaseous fuel burning consumer or commercial appliance, such as a hot water heater, furnace, stove, etc. However, while the following description will describe embodiments of the present invention as used in such an environment, those skilled in the art will recognize that other applications of these and other embodiments of the invention are within the scope of the invention, and therefore the following description should be taken by way of example, and not by way of limitation.

As illustrated in FIG. 1, the flame sense circuit 100 utilizes resistors 102 and 104 to form a voltage divider that provides 60 VAC to the spark/flame sense probes illustrated in FIG. 1 as E1 and E2. As will be recognized by those skilled in the art, the electrodes E1 and/or E2 may be used for both the spark generation in an DSI ignition system and the flame sensing. In other embodiments that utilize, e.g., hot surface ignition, a separate flame sense electrode would be required. As such, the following description will refer to either or both of the electrodes E1 and/or E2 as flame sense electrodes.

This 60 VAC signal provides the alternating current signal to the flame sense electrodes E1 and E2 so that the flame can rectify it through the flame rectification property of fire. This circuit 100 is capable of detecting a flame on either one of the flame sense electrodes E1 or E2 because the secondary winding 106 of the spark transformer 108 connects these two electrodes together. The capacitor 110 is used to pass the 60 volt, 60 Hz AC signal while blocking the DC rectified flame signal.

When a flame is present, the negative DC flame current resulting from the flame rectification will flow through the resistor 112 and will reduce the voltage on capacitor 114 from 5 volts, with no flame present, to less than 1 volt when a flame is sensed on either or both of electrodes E1 and E2. The resistor 116 is used to protect capacitor 110 from the high voltage surge resulting from the spark generated between electrodes E1 and E2 in a DSI ignition embodiment such as that shown in FIG. 1. This resistor 116 along with resistor 118 and with capacitor 114 form a low pass filter that reduces the 60 Hz ripple passed through capacitor 110.

When no flame is present, current flows from the +5 volt source through resistor 112 to charge the flame capacitor 114 to 5 volts, or a logic level high. Resistor 120 is used to protect the input/output pin of the microcontroller 122. As will be discussed more fully below, this single pin is used both to detect the presence of flame and to reset the flame sense circuitry. Such a microcontroller may be, for example, part number PIC16F726I/P available from Microchip Inc., Chandler, Ariz. As will be recognized by those skilled in the art, the microcontroller 122 also controls the spark circuitry 124 to ignite the gaseous fuel in embodiments that utilize DSI, or the other ignition circuitry used in other embodiments.

During operation when no flame is present, the flame sense capacitor 114 is charged to a high logic level of approximately 5 volts DC. Since no flame is present, there is no path to ground from either of the spark/flame sense electrodes E1, E2. Once a flame has been ignited, however, a path from the spark/flame sense electrodes E1, E2 to the grounded burner (not shown) through the flame is provided. The negative DC current caused by the flame rectification will then flow through resistor 112 and reduce the voltage on the flame sense capacitor 114 to a logic level low of less than 1 volt DC. This logic level low will be sensed by the microcontroller 122 by a single high impedance input pin.

Once the microcontroller 122 has sensed the logic level low from the flame sense capacitor 114 to verify the presence of flame, the microcontroller 122 switches that same pin from a high impedance input pin to a logic level high output pin to charge the flame sense capacitor 114 through resistor 120 to a logic level high again. This charging is made possible, in part, by the relative sizing of the resistors used in the circuit. In one embodiment, resistor 120 is a 47 kΩ resistor, resistor 112 is a 22 MΩ, resistor 118 is a 4.7 MΩ resistor, and resistor 116 is a 1 MΩ resistor.

Once the microcontroller 122 has charged the flame sense capacitor 114 back to a logic level high, the microcontroller 122 again switches that same pin to a high impedance input pin so that it can read the logic level of the flame sense capacitor 114 to ensure that it has been recharged to a logic level high. If the capacitor 114 has not returned to a logic level high, the microcontroller 122 knows that a problem exists in the system.

Assuming that the recharge was successfully accomplished and assuming that the flame is still present as sensed by either or both of electrodes E1 and E2, the logic level of the flame sense capacitor 114 will again transition to a logic level low as the negative DC current again reduces the charge thereon through flame rectification. This process is repeated during the combustion event to continually ensure that a flame is present while gaseous fuel is being released to the burner.

Figure 2:
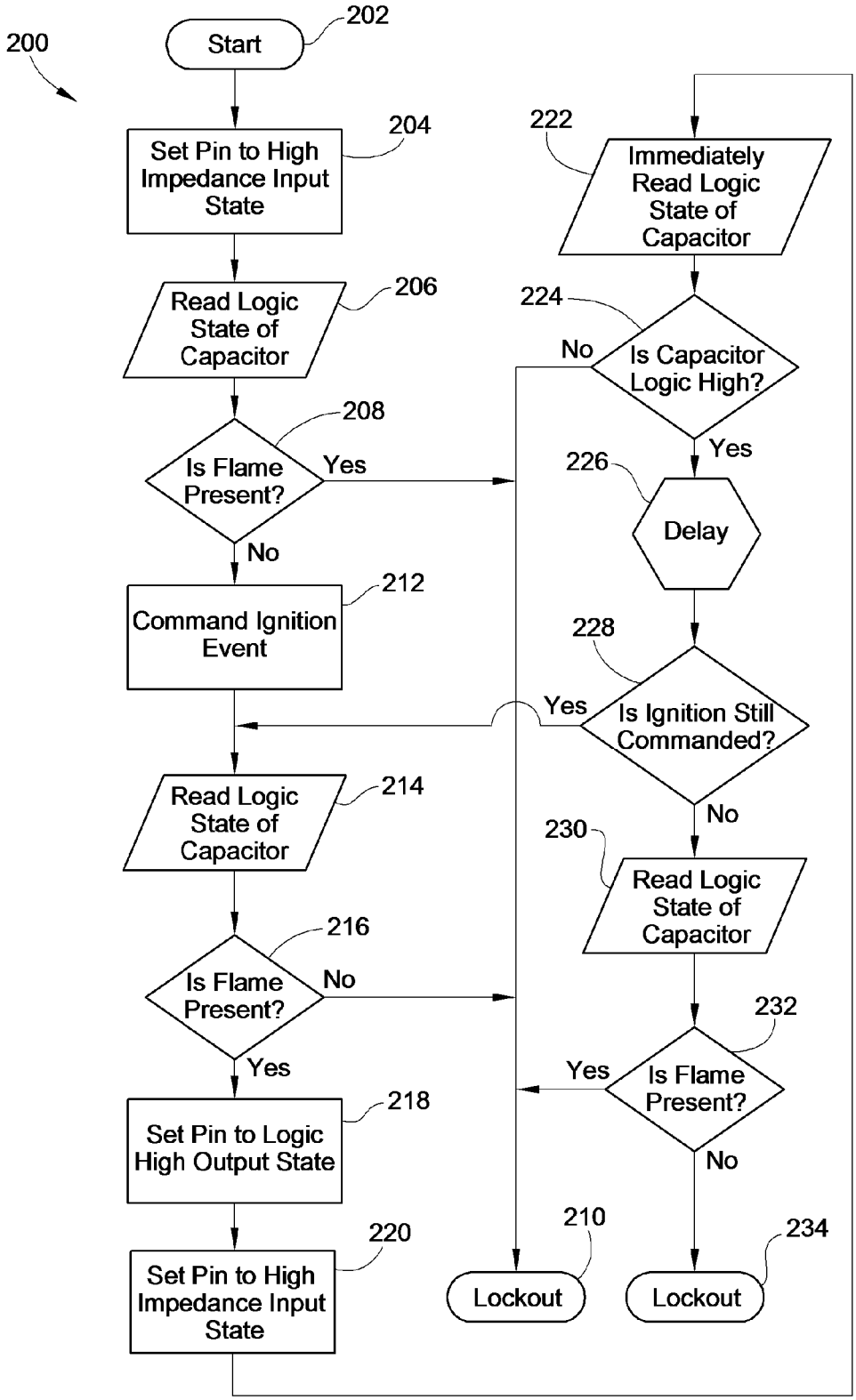
FIG. 2 is a simplified logic flow diagram illustrating one embodiment of the method of the present invention.

To better understand one embodiment of the fail safe flame detection method 200 of the present invention, attention is now directed to the flow diagram of FIG. 2. Once the microcontroller starts 202 this process, the single pin used in this circuit and for this method is set to a high impedance input state as indicated by process block 204. Initially, the logic state of the flame sense capacitor 114 (see FIG. 1) is read a block 206. If a flame is detected, by reading a logic level low, at decision block 208, the system enters a lockout 210 mode of operation to indicate a failure in the system. Such a failure may be a result of a faulty gas flow control valve that is not fully shut off the flow of gas to the burner during a previous cycle such that a flame continues to burn therein. It could also indicate a failure in the flame sense circuitry itself. In any event, the system enters the lockout mode of operation.

If, however, at decision block 208 no flame is detected, the microcontroller can safely command an ignition event as indicated by process block 212. To determine whether the ignition event was successful, the controller then reads the logic state of the flame sense capacitor at process block 214. If no flame is present as determined by decision block 216 the system will once again enter a lockout 210 mode of operation since a continued release of un-combusted gaseous fuel may result in a hazardous condition.

If, however, at decision block 216 it is determined that flame has been successfully ignited, the microcontroller than sets the pin utilized for this circuitry to a logic high output state at process block 218 to recharge the flame sense capacitor to a "no flame detected" state. The microcontroller then sets the pin back to a high impedance input state at process block 220 and thereafter immediately reads the logic state of the capacitor at process block 222. If the capacitor's logic state as determined by decision block 224 is not high, then the system enters a lockout mode of operation 210 to indicate the inability of the controller to properly recharge the flame sense capacitor to allow continual verification of the presence of flame during the entire combustion event.

If, however, at decision block 224 it is determined that the microcontroller has successfully returned the flame sense capacitor to a logic high state, the microcontroller waits a short predetermined period of time at delay block 226 to enable the flame sense circuitry to again detect the presence of flame at one or both electrodes. If the ignition is still commanded, i.e. if a heating cycle is still in operation as determined by decision block 228, then the method returns to process block 214 to provide the continual checking of the presence of flame during the entire combustion event.

If, however, at decision block 228 it is determined that the combustion event has ended, the microcontroller again reads the logic state of the flame sense capacitor at process block 230 to determine whether or not flame is still present at decision block 232. If flame is still present despite the microcontroller having ended the combustion event, the system again enters lockout 210 to indicate that erroneous operation is occurring and maintenance is required. If, however, flame is not detected then the process will end 234.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A flame sense circuit, comprising:

a first node having coupled thereto, through a blocking capacitor, an external source of alternating current (AC) voltage;

a flame sense electrode electrically coupled to the first node;

a second node coupled to the first node through a resistor and to an external source of direct current (DC) voltage;

a flame sense capacitor coupled between the second node and ground; and a microcontroller having a only one pin electrically coupled to the second node, the microcontroller configured to alternatively read a voltage on the second node and apply a DC voltage to the second node, the only one pin used to detect a presence of flame and reset flame sense circuitry.

2. The flame sense circuit of claim 1, further comprising a voltage divider coupled between the blocking capacitor and the external source of AC voltage.

3. The flame sense circuit of claim 2, wherein the voltage divider comprise a series connected pair of resistors, and wherein the blocking capacitor is coupled between the pair of resistors.

4. The flame sense circuit of claim 1, wherein the flame sense electrode is coupled to a spark generation circuit, further comprising a spike reducing resistor coupled between the first node and the flame sense electrode.

5. The flame sense circuit of claim 1, further comprising a resistor coupled between the second node and the external source of DC voltage.

6. The flame sense circuit of claim 1, further comprising a resistor coupled between the second node and the only one pin of the microcontroller.

7. A method of determining the continued presence of flame via a flame sense circuit having a flame sense capacitor that is charged to a high logic level in the absence of flame and is drained to a low logic level in the presence of flame using only a single pin on a microcontroller electrically coupled to the flame sense capacitor, comprising the steps of:

setting the single pin of the microcontroller to a high impedance input state;

reading the logic level of the single pin to determine the logic level of the flame sense capacitor;

resetting the single pin of the microcontroller to a logic level high output state to charge the flame sense capacitor to a high logic level; and repeating the steps of setting, reading, resetting, and repeating so long as flame is to be present.

8. The method of claim 7, further comprising the step of verifying that the logic level of the single pin is initially a high logic level during the step of reading after the steps of resetting and setting.

9. The method of claim 8, further comprising the step of entering a lockout mode of operation when the step of reading determines that the flame sense capacitor is not initially a high logic level.

10. The method of claim 8, wherein the step of verifying further comprises the step of verifying that the logic level of the single pin changes from a high logic level to a low logic level during the step of reading after the steps of resetting and setting.

11. The method of claim 10, further comprising the step of entering a lockout mode of operation when the step of reading determines that the flame sense capacitor does not change from a high logic level to a low logic level.

12. The method of claim 7, wherein the flame is commanded off, the method further comprising the steps of:

resetting the single pin of the microcontroller to a logic level high output state to charge the flame sense capacitor to a high logic level;

setting the single pin of the microcontroller to a high impedance input state;

reading the logic level of the single pin to determine the logic level of the flame sense capacitor; and entering a lockout mode of operation when the step of reading determines that the flame sense capacitor is a low logic level.

13. The method of claim 7, wherein before flame is commanded on, the method further comprises the steps of:

reading the logic level of the single pin to determine the logic level of the flame sense capacitor; and entering a lockout mode of operation when the step of reading determines that the flame sense capacitor is a low logic level.

14. A method of determining proper operation of a gas burning appliance by using only a single pin on a microcontroller of the appliance, the appliance having a flame sense circuit that utilizes a flame sense capacitor which is charged to a high logic level in the absence of flame at a burner and is drained to a low logic level when flame is detected by a flame sense electrode, the single pin of the microcontroller being electrically coupled to the flame sense capacitor, comprising the steps of:

a) setting a pin of the microcontroller to a high impedance input state;

b) reading the pin to determine the logic state of the flame sense capacitor;

c) if the logic state of the flame sense capacitor is low, entering a lockout state of operation;

d) if the logic state of the flame sense capacitor is high, commanding an ignition event;

e) reading the pin to determine the logic state of the flame sense capacitor;

f) if the logic state of the flame sense capacitor is high, entering the lockout state of operation;

g) if the logic state of the flame sense capacitor is low, resetting the pin to a high logic level output to charge the flame sense capacitor to a high logic level;

h) setting the pin to a high impedance input state;

i) reading the pin to determine the logic state of the flame sense capacitor;

j) if the logic state of the flame sense capacitor is initially low, entering the lockout state of operation;

k) if the logic state of the flame sense capacitor is initially high and the ignition is still commanded, repeating the steps of e), g), h), and i) so long as the ignition is still commanded.

15. The method of claim 14, further comprising the steps of:

l) ending the ignition event;

m) resetting the pin to a high logic level output to charge the flame sense capacitor to a high logic level;

n) setting the pin to a high impedance input state;

o) reading the pin to determine the logic state of the flame sense capacitor;

p) if the logic state of the flame sense capacitor is low, entering the lockout state of operation.

* * * * *